US005960753A

United States Patent [19]

Sturman

[11] Patent Number: 5,960,753

[45] **Date of Patent: *Oct. 5, 1999**

[54] HYDRAULIC ACTUATOR FOR AN INTERNAL COMBUSTION ENGINE

[76] Inventor: Oded E. Sturman, 3973 Santa Monica Ct., Newbury Park, Calif. 91320

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/899,801

[22] Filed: Jul. 24, 1997

Related U.S. Application Data

[63] Continuation of application No. 08/807,668, Feb. 27, 1997, Pat. No. 5,713,316, which is a continuation of application No. 08/442,665, May 17, 1995, Pat. No. 5,638,781.

[51] Int. Cl.[6] ..... F01L 9/02

[52] U.S. Cl. ..... 123/90.12; 123/90.11

[58] Field of Search ..... 123/90.11, 90.12, 123/90.13, 90.14; 251/129.1

[56] References Cited

U.S. PATENT DOCUMENTS

| | | | |
|---|---|---|---|
| 3,209,737 | 10/1965 | Omotehara et al. | 123/90.12 |
| 4,396,037 | 8/1983 | Wilcox | 251/129.1 |
| 5,003,937 | 4/1991 | Matsumoto et al. | 123/90.12 |
| 5,124,598 | 6/1992 | Kawamura | 123/90.11 |
| 5,193,495 | 3/1993 | Wood, III | 123/90.12 |
| 5,327,856 | 7/1994 | Schroeder et al. | 123/90.11 |
| 5,335,633 | 8/1994 | Thien | 123/90.12 |
| 5,339,777 | 8/1994 | Cannon | 123/90.12 |
| 5,410,994 | 5/1995 | Schechter | 123/90.12 |
| 5,456,221 | 10/1995 | Schechter | 123/90.12 |
| 5,507,316 | 4/1996 | Meyer | 123/90.12 |
| 5,577,468 | 11/1996 | Weber | 123/90.12 |
| 5,598,871 | 2/1997 | Sturman et al. | 251/129.1 |
| 5,638,781 | 6/1997 | Sturman | 123/90.12 |
| 5,713,316 | 2/1998 | Sturman | 123/90.12 |

*Primary Examiner*—Weilun Lo
*Attorney, Agent, or Firm*—Blakely Sokoloff Taylor & Zafman

[57] ABSTRACT

A camless intake/exhaust valve for an internal combustion engine that is controlled by a solenoid actuated fluid control valve. The control valve has a pair of solenoids that move a spool. Energizing one solenoid moves the spool and valve into an open position. The valve spool is maintained in the open position by the residual magnetism of the valve housing and spool even when power is no longer provided to the solenoid. Energizing the other solenoid moves the spool and valve to a closed position. The solenoids are digitally latched by short digital pulses provided by a microcontroller. The valve is therefore opened by providing a digital pulse of a short duration to one of the solenoids and closed by a digital pulse that is provided to the other solenoid. The valve may be opened by a plurality of pins. One of the pins may engage a stop so that the valve is initially opened with a relatively high force and then moved into the fully opened position with a lower force.

9 Claims, 6 Drawing Sheets

HYDRAULIC ACTUATOR FOR AN INTERNAL COMBUSTION ENGINE

This is a Continuation Application of application Ser. No. 08/807,668, filed Feb. 27, 1997, now U.S. Pat. No. 5,713, 316, which is a Continuation of Application of application Ser. No. 08/442,665, filed May 17, 1995, now U.S. Pat. No. 5,638,781.

BACKGROUND OF THE INVENTION

1. Field of the Invention

The present invention relates to a hydraulically controlled intake valve for an internal combustion engine.

2. Description of Related Art

Internal combustion engines contain an intake valve and an exhaust valve for each cylinder of the engine. In a compression ignition (CI) engine the intake valve allows air to flow into the combustion chamber and the exhaust valve allows the combusted air/fuel mixture to flow out of the chamber. The timing of the valves must correspond to the motion of the piston and the injection of fuel into the chamber. Conventional CI engines incorporate cams to coordinate the timing of the valves with the piston and the fuel injector. Cams are subject to wear which may affect the timing of the valves. Additionally, cams are not amenable to variations in the valve timing during the operation of the engine.

U.S. Pat. No. 5,125,370 issued to Kawamura; U.S. Pat. No. 4,715,330 issued to Buchl and U.S. Pat. No. 4,715,332 issued to Kreuter disclose intake valves that are controlled by solenoids. Each valve is moved between an open position and a closed position by energizing the solenoids. The amount of power required to actuate the solenoids and move the valves is relatively large. The additional power requirement reduces the energy efficiency of the engine.

U.S. Pat. Nos. 4,200,067 and 4,206,728 issued to Trenne; U.S. Pat. Nos. 5,248,123, 5,022,358 and 4,899,700 issued to Richeson; U.S. Pat. No. 4,791,895 issued to Tittizer; U.S. Pat. No. 5,237,968 issued to Miller et al. and U.S. Pat. No. 5,255,641 issued to Schechter all disclose hydraulically controlled intake valves. The hydraulic fluid is typically controlled by a solenoid control valve. The solenoid valves described and used in the prior art require a constant supply of power to maintain the valves in an actuating position. The continuous consumption of power reduces the energy efficiency of the engine. Additionally, the solenoid control valves of the prior art have been found to be relatively slow thus restricting the accuracy of the valve timing. It would therefore be desirable to provide a camless intake valve that was fast and energy efficient.

The exhaust valve of a internal combustion engine is opened for the exhaust stroke of the engine cycle. Before the exhaust valve is opened, there is a differential pressure across the valve equal to the difference between the pressure of the exhaust gas within the combustion chamber and the pressure within the exhaust manifold. The force required to open the valve must be large enough to overcome this differential pressure. When the valve is initially opened, the exhaust gas flows out of the combustion chamber and rapidly reduces the pressure within the chamber. After the exhaust valve is initially opened, the force that continues to open the valve is generally must larger than the energy required to overcome the gas pressure within the chamber. This additional work ultimately lowers the energy efficiency of the engine. The lost energy can be significant when multiplied by the number of exhaust strokes performed by an engine. It would therefore be desirable to provide an exhaust valve assembly that optimizes the opening force of the valve.

SUMMARY OF THE INVENTION

The present invention is a camless intake/exhaust valve for an internal combustion engine that is controlled by a solenoid actuated fluid control valve. The control valve has a pair of solenoids that move a spool. Energizing one solenoid moves the spool and valve into an open position. The valve spool is maintained in the open position by the residual magnetism of the valve housing and spool even when power is no longer provided to the solenoid. Energizing the other solenoid moves the spool and valve to a closed position. The solenoids are digitally latched by short digital pulses provided by a microcontroller. The valve is therefore opened by providing a digital pulse of a short duration to one of the solenoids and closed by a digital pulse that is provided to the other solenoid. The valve may be opened by a plurality of pins. One of the pins may engage a stop so that the valve is initially opened with a relatively high force and then moved into the fully opened position with a lower force.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
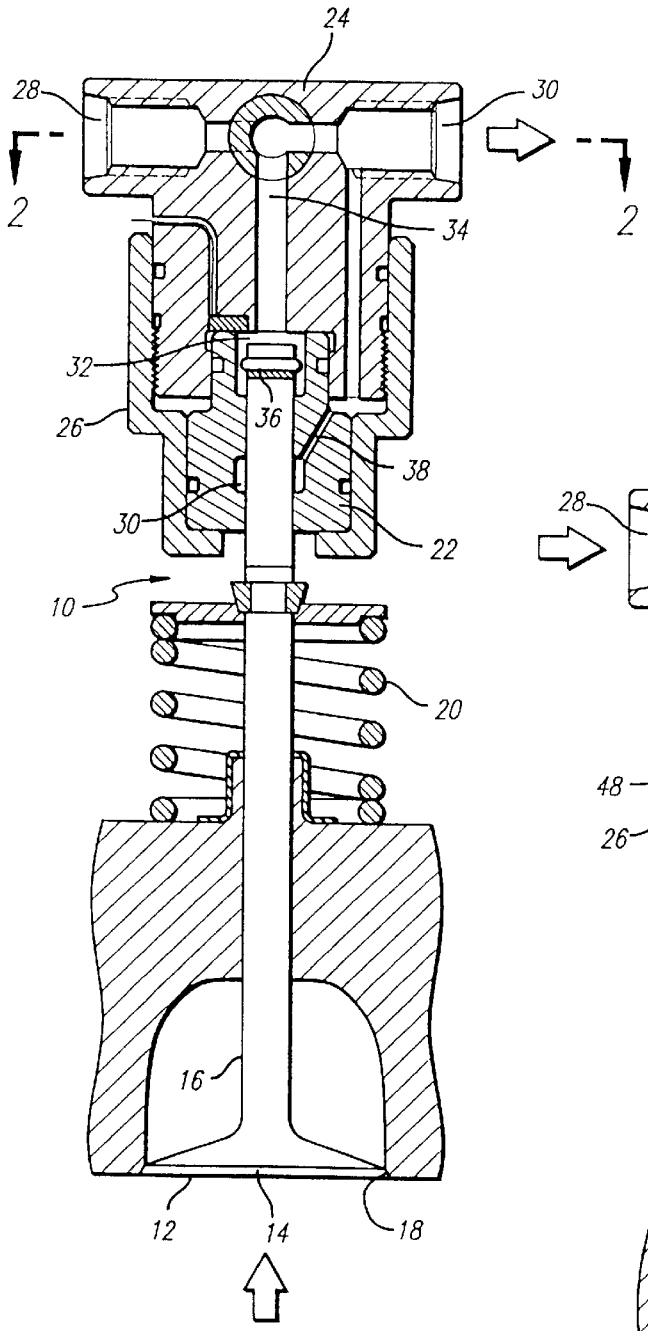
FIG. 1 is a cross-sectional view of a camless intake valve of the present invention.
Figure 3:
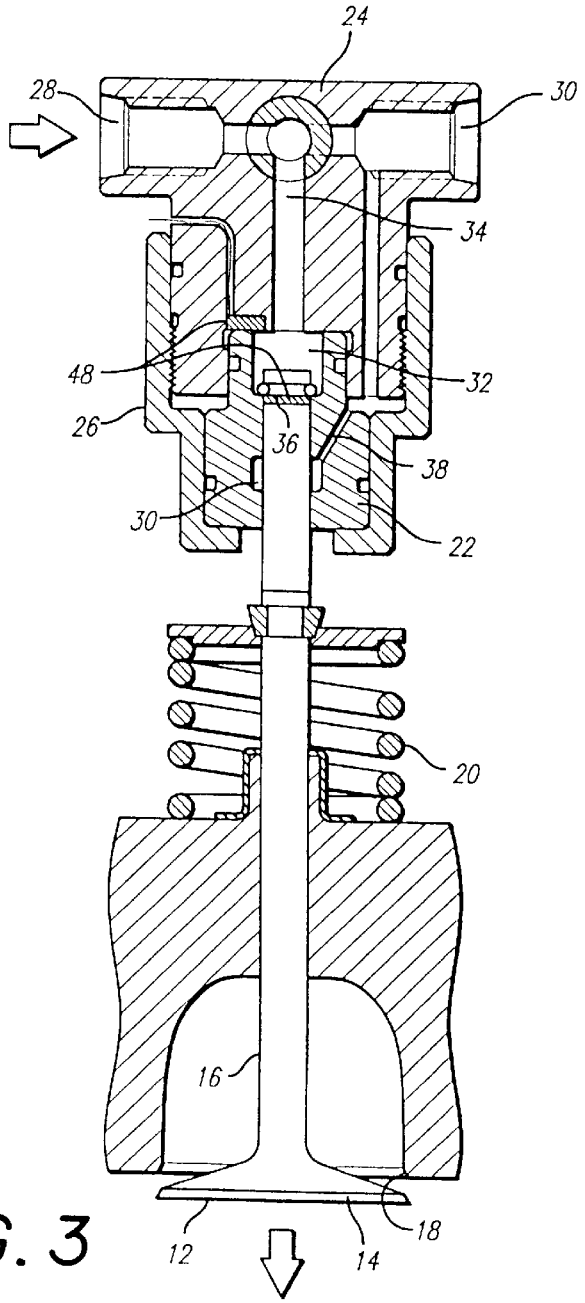
FIG. 3 is a cross-sectional view of the intake valve in an open position.

Referring to the drawings more particularly by reference numbers, FIG. 1 shows a valve assembly 10 of the present invention. The valve assembly 10 is typically incorporated into an internal combustion engine as either an intake or exhaust valve. The assembly 10 has a valve 12 that includes a seat 14 located at the end of a valve stem 16. The seat 14 is located within an opening 18 in the internal combustion chamber of the engine. The valve 12 can move between an open position and a closed position. The assembly 10 may include a spring 20 that biases the valve 12 into the closed position.

The assembly 10 may include a barrel 22 that is coupled to a valve housing 24 by an outer shell 26. The valve housing 24 has a first port 28 that is connected to a pressurized working fluid. For example, the first port 28 may be coupled to the output line of a pump (not shown). The housing 24 also has a second port 30 connected to a low pressure line. For example, the second port 30 may be coupled to a reservoir of the working fluid system. The working fluid may be engine fuel or a separate hydraulic fluid.

The barrel 22 has a pressure chamber 32 that is coupled to a first passage 34 in the valve housing 24. The end of the valve stem 16 is located within the pressure chamber 32. When a high pressure working fluid is introduced to the chamber 32, the resultant fluid force pushes the stem 16 and the valve 12 into the open position. The stem 16 may have a stop 36 that limits the travel of the valve 12. The barrel 22 and valve housing 24 may have a drain passage 38 in fluid communication with the second port 30. The passage 38 drains any working fluid that leaks between the stem and the barrel back to the system reservoir.

Figure 2:
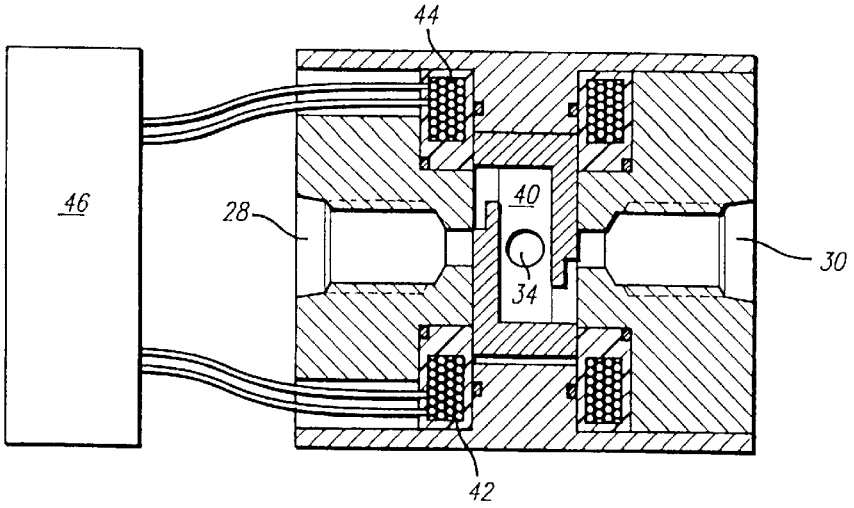
FIG. 2 is a side cross-sectional view showing the solenoid control valve of the intake valve.

As shown in FIG. 2, the assembly has a spool 40 that is coupled to a first solenoid 42 and a second solenoid 44. The flow of working fluid through the passage 34, and ports 28 and 30 are controlled by the position of the spool 40. When the first solenoid 42 is energized, the spool 40 is moved into a first position, wherein the first port 28 is in fluid communication with the pressure chamber 32. When the second solenoid 44 is energized, the spool 40 is moved to a second position, wherein the second port 30 is in fluid communication with the pressure chamber 32.

The solenoids 42 and 44 are connected to a microcontroller 46 that controls the operation of the valve. The controller 46 energizes each solenoid with a short digital pulse. The spool 40 and valve housing 24 are preferably constructed from a magnetic material such as a 52100 or 440c hardened steel. The magnetic material has a hysteresis which will maintain the spool 40 in position even after power to the solenoid is terminated. The spool 40 is moved to a new position by energizing one solenoid with a short duration digital pulse. There is no power provided to the solenoid to maintain the position of the spool 40. The residual magnetism will maintain the position of the spool 40.

In operation, to open the valve 12, the controller 46 energizes the first solenoid 42 and moves the spool 40 to the first position. Movement of the spool 40 couples the high pressure first port 28 with the pressure chamber 32, wherein the high pressure working fluid pushes the valve 12 into the open position. To close the valve, the controller 46 provides a digital pulse to the second solenoid 44 to move the spool 40 to the second position and couple the pressure chamber 32 to the return line of the second port 30. The spring 20 moves the valve 12 back into the closed position.

The assembly 10 may have a sensor 48 that is coupled to the valve 12. The sensor 48 provides an indication on the position of the valve 12. The sensor 48 may be a Hall Effect sensor which provides an output voltage that varies with the distance from the valve stem to the sensing device. The sensor 48 provides feedback so that the controller 46 can accurately open and close the valve. Additionally, it may be desirable to move the valve to a location between the open and closed positions. For example, when braking an engine it is typically desirable to maintain the exhaust valve in a slightly open position during the power stroke of the engine. The controller 46 can move the spool 40 between the first and second positions so that the valve is in an intermediate position.

Figure 4:
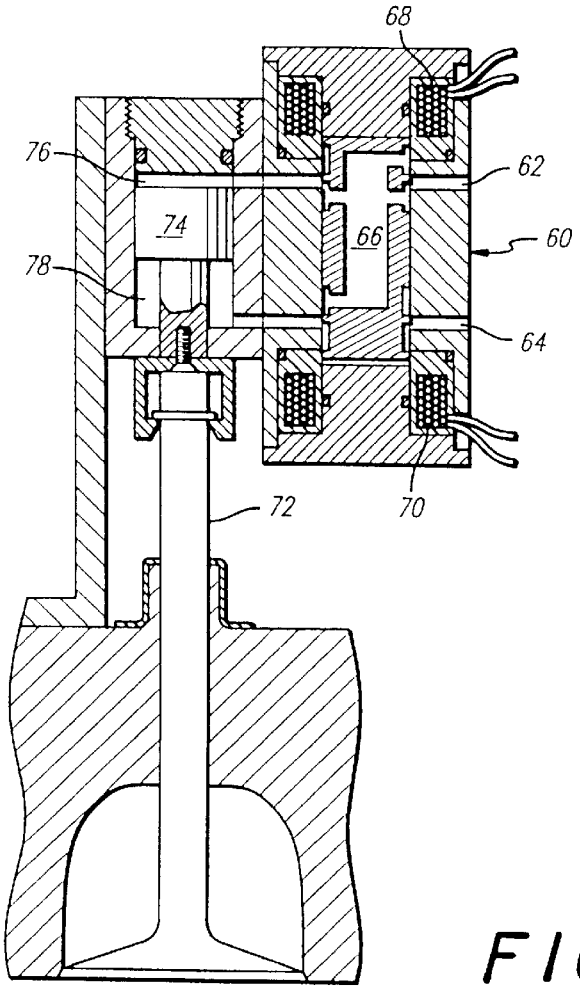
FIG. 4 is a cross-sectional view of an alternate embodiment of an intake valve with a four-way solenoid control valve.

FIG. 4 shows an alternate embodiment of an assembly that does not have a spring 20 and utilizes a digitally latched four-way control valve 60. The valve 60 has a supply port 62 and a return port 64. The valve 60 contains a spool 66 that is controlled by solenoids 68 and 70. The valve stem 72 has a piston 74 that creates a first subchamber 76 and a second subchamber 78. When the spool 62 is in the first position, the supply port 62 is in fluid Communication with the first subchamber 76 and the return port 64 is in fluid communication with the second subchamber 78, wherein the high pressure working fluid pushes the valve into the open position. When the spool 60 is moved into the second position the supply port 62 is in fluid communication with the second subchamber 78 and the return port 64 is in fluid communication with the first subchamber 76, wherein the high pressure working fluid within the second subchamber 78 pushes the valve back to the closed position. Generally speaking, the four-way valve provides a more accurate control of the valve than a spring return valve which has an inherent time delay for the working fluid to overcome the force of the spring when the valve is being opened. The four-way valve embodiment shown in FIG. 4, can also be used to move the valve 12 to an intermediate position between the open and closed positions.

Figure 5:
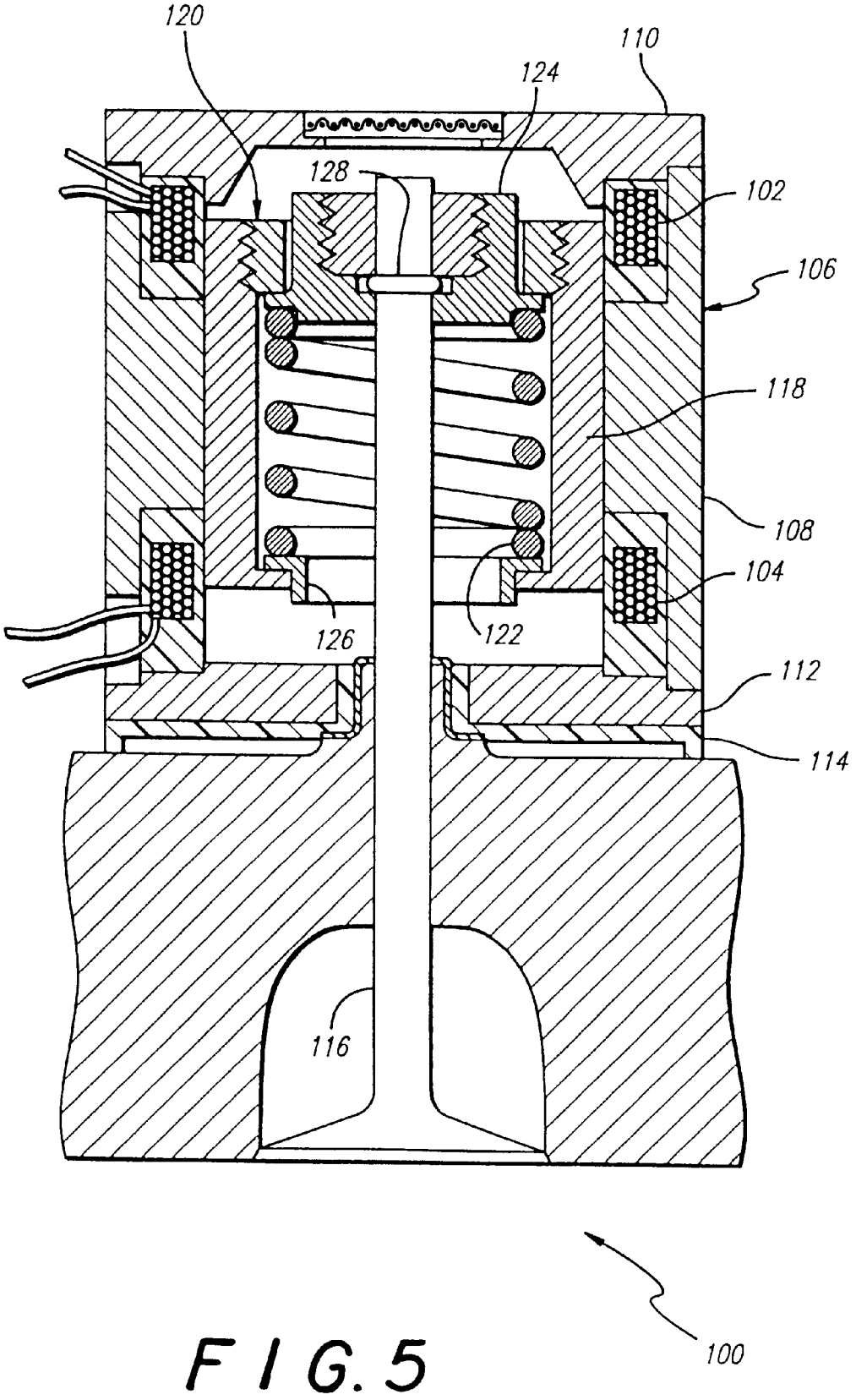
FIG. 5 is a side cross-sectional view of an alternate embodiment of an intake valve with a pair of digitally latched solenoids.

FIG. 5 shows another alternate embodiment of an intake valve 100 which has a pair of digitally latched solenoids. The valve has a first solenoid 102 and a second solenoid 104 that are each energized by a short duration digital pulse. The solenoids 102 and 104 are located within a housing 106 that has a main body 108 and a pair of end caps 110 and 112. The housing 106 also has a non-magnetic base member 114.

The valve stem 116 is coupled to an armature 118 by a spring subassembly 120. The subassembly 120 contains a spring 122 that is captured by a pair of collars 124 and 126. The collars 124 and 126 are captured by the armature 118. Collar 124 is attached to the valve stem 116 by a clip 128. The armature 118, and end caps 110 and 112 are constructed from a magnetic material that has enough residual magnetism to maintain the position of the valve in either an open or closed position. The spring 122 can be deflected to allow the armature 118 to come into contact with the end caps.

In operation, the valve can be moved to the open position by actuating the second solenoid 104. The valve can be closed by actuating the first solenoid 102. In addition to allowing contact between the armature 118 and the end caps 110 and 112, the spring 122 also dampens the impact of the valve movement and provides stored energy to move the armature 118 away from the end caps.

Figure 6:
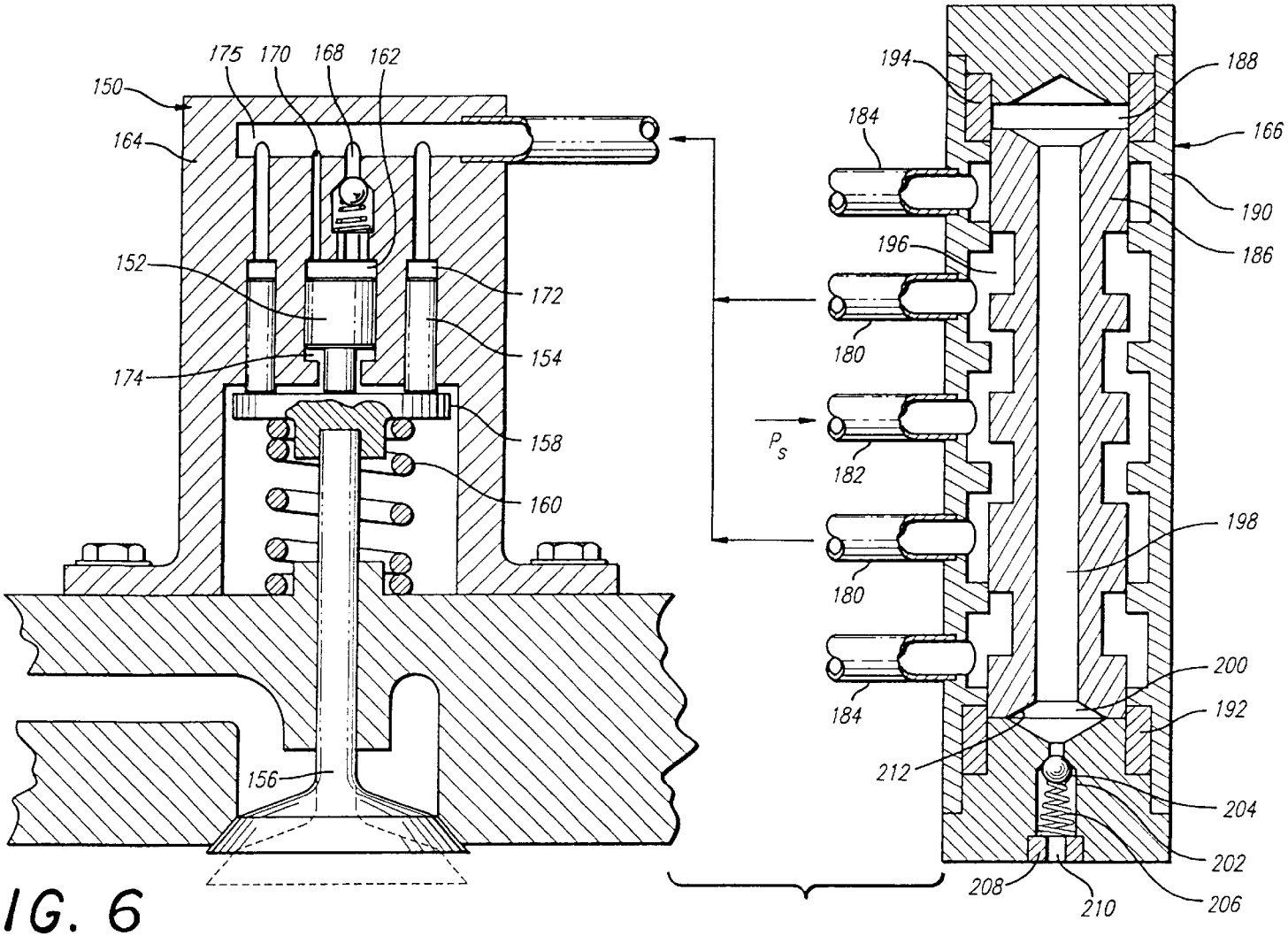
FIG. 6 is a side cross-sectional view of an alternate embodiment of an intake valve with a plurality of pins that open the valve.

FIG. 6 shows an alternate embodiment of a valve assembly 150. The assembly 150 includes a first pin 152 and a pair of second pins 154 that push a valve 156 into an open position. The pins 152 and 154 press against a valve collar 158 that is attached to said valve 156. The valve collar 158 captures a spring 160 that biases the valve 156 into a closed position. In the preferred embodiment, the first pin 152 has an area approximately four times larger than the combined area of the second pins 154.

The first pin 152 is located within a pressure chamber 162 of a valve housing 164. The pressure chamber 162 is in fluid communication with a control valve 166. Fluid communication between the pressure chamber 162 and the valve 166 may be provided by a one-way check valve 168 that allows flow into the chamber 162, and an orifice 170 that restricts the flow of fluid out of the pressure chamber 162. The second pins 154 are located within channels 172 that are in fluid communication with the control valve 166. The valve housing 164 has a stop 174 that limits the movement of the first pin 152 so that the valve 156 is initially opened by all of the pins 152 and 154, and then further opened only with the second pins 154.

The control valve 166 has a pair of cylinder ports 180 that are both coupled to the pressure chamber 162 and channels 172 by a main channel 175. The valve 166 also has a single supply port 182 that is coupled to a source of pressurized fluid and a pair of return ports 184 each coupled to a drain line. The valve 166 can be switched between a first position that couples the cylinder ports 180 to the supply port 182 to allow fluid to flow into the pressure chamber 162 and channels 172, and a second position that couples the cylinder ports 180 to the return ports 184 to allow fluid to flow out of the pressure chamber 162 and channels 172.

The valve 166 contains a spool 186 that moves within the inner chamber 188 of a housing 190. Within the housing 190 is a first solenoid 192 that can pull the spool 186 to the first position and a second solenoid 194 that can move the spool 186 to the second position. The solenoids 192 and 194 are connected to an external power source which can energize one of the solenoids to move the spool 186 to the desired position.

In the preferred embodiment, both the housing 190 and the spool 186 are constructed from a magnetic steel such as 440c or 52100. The hysteresis of the magnetic steel is such that the magnetic field within the spool 186 and the housing 190 will maintain the position of the spool 186 even when the solenoid is de-energized. The magnetic steel allows the valve to be operated in a digital manner, wherein one solenoid is energized for a predetermined time interval until the spool 186 is adjacent to an inner surface of the housing 190. Once the spool 186 has reached the new position, the solenoid is de-energized, wherein the hysteresis of the magnetic steel material maintains the position of the spool 186.

The spool 186 has outer grooves 196 that couple the cylinder ports 180 to either the supply port 182 or the return ports 184. The cylinder ports 180 are located on each side of the supply port 182 to dynamically balance the valve 166 when the spool 186 is moved from the first position to the second position. The fluid flowing through the cylinder ports has an associated resultant force that is applied to the spool 186. Placing the ports 180 on each side of the supply port 182 produces resultant fluid forces that are applied to the spool 186 in opposite directions. The opposing forces offset each other so that the fluid forces do not counteract the pulling force of the solenoid 192 on the spool 186. Likewise, the return ports 184 are located on each side of the cylinder ports 182 so that the resultant forces created by the fluid flowing through the return ports cancel each other, thereby preventing a counteracting force from impeding the pulling force of the solenoid 194. The port locations of the valve thus provide a fluid control valve that is dynamically pressure balanced. Balancing the spool 186 increases the response time of the valve and reduces the energy required by the solenoids to pull the spool 186 from one position to another.

The spool 186 has an inner channel 198 and a pair of end openings 200 that are in fluid communication with the inner chamber 188 of the housing 190. The end openings 200 and inner channel 198 allow fluid within the inner chamber 188 to flow away from the end of the spool 186, when the spool 186 is pulled to a new position. By way of example, when the second solenoid 194 pulls the spool 186 toward the housing 190, the fluid located between the end of the spool 186 and the housing 190 flows into the inner channel 198 through the end opening 200. The flow of fluid prevents a build-up of hydrostatic pressure which may counteract the pull of the solenoid. The inner channel 198 and end openings 200 thus statically pressure balance the spool 186.

The valve 166 may have a pressure relief valve 202 that releases fluid when the fluid pressure within the inner chamber 188 exceeds a predetermined value. The relief valve 202 may have a ball 204 that is biased into a closed position by a spring 206. The relief valve 202 may also have an insert 208 with an outlet port 210. The ends of the spool and the inner surface of the housing may have chamfered surfaces 212 to increase the volume of the inner chamber 188 between the spool 186 and the housing 190 and reduce the hydrostatic pressure within the valve 166.

In operation, a digital pulse is provided to the control valve 166 to switch the valve 166 and allow a pressurized working fluid to flow into the pressure chamber 162 and channels 172. The pressurized fluid exerts a force onto the pins 152 and 154 which push the valve 156 into the open position.

Figure 7:
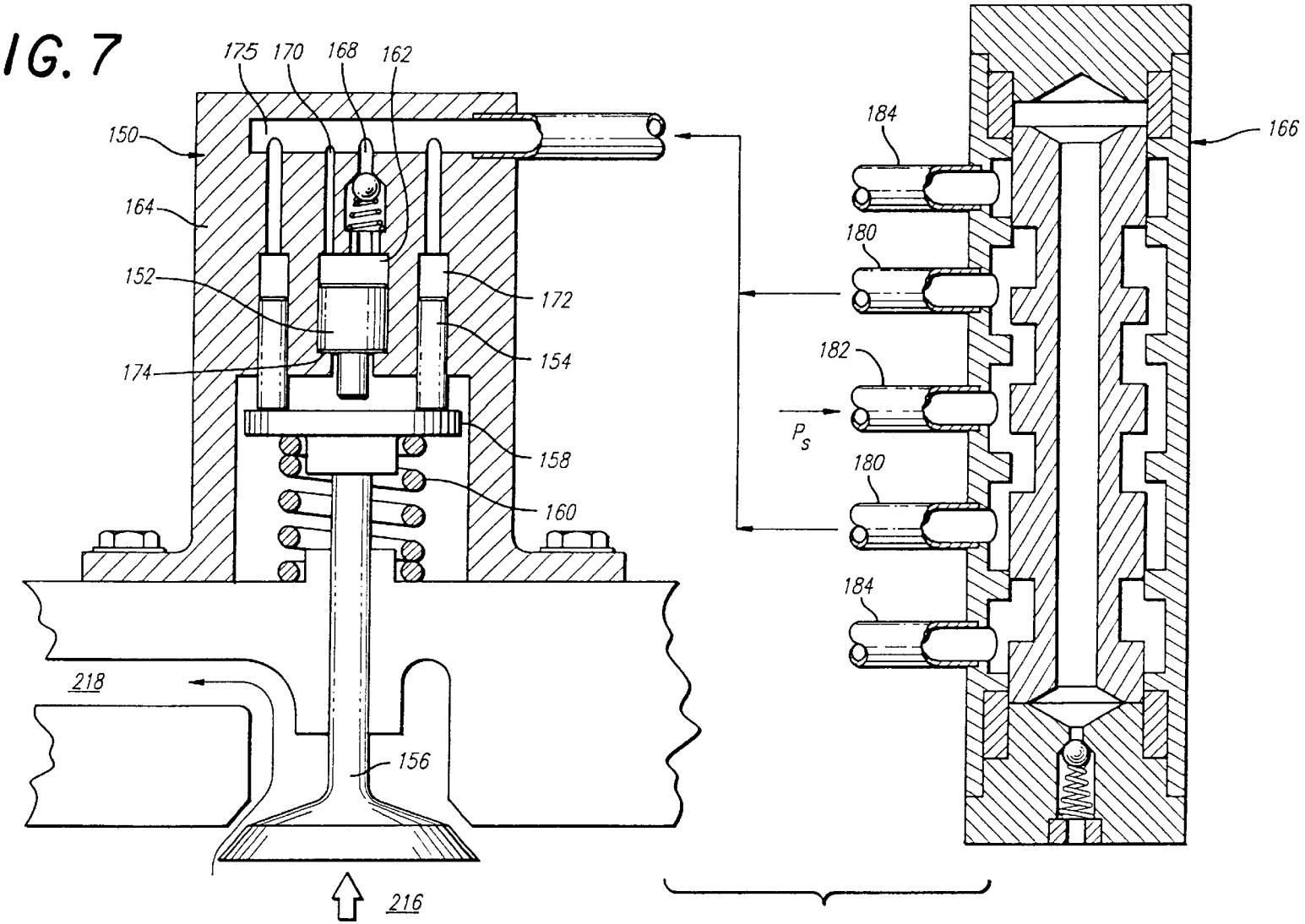
FIG. 7 is a cross-sectional view similar to FIG. 6, showing one of the pins engaging a stop.

As shown in FIG. 7, the stop 174 prevents further movement of the first pin 152 while the second pins 154 continue to push the valve 156 into the fully opened position. To close the valve 156, a digital pulse is provided to switch the control valve 166 to couple the pressure chamber 162 and channels 172 to drain. The force of the spring 160 pushes the valve back to the closed position. The orifice 170 restricts the flow of working fluid out of the pressure chamber 162 and reduces the speed of the valve 156 back to the closed position. The orifice 170 provides a damping function which prevents the valve 156 from "banging" against the valve seat. The damping of the valve reduces the wear and increases the life of the valve seat 214.

The dual pin valve assembly 150 is particularly desirable for use as an exhaust valve. During the exhaust stroke of an internal combustion engine the pressure within the combustion chamber 216 is relatively high. The work provided by the hydraulic fluid must be great enough to overcome the combustion chamber pressure and open the valve. When the valve 150 is initially opened, the exhaust gases within the combustion chamber flow out into the exhaust manifold 218. The flow of exhaust gas into the exhaust manifold 218 rapidly reduces the pressure within the combustion chamber 216. Because of the lower combustion chamber pressure and the momentum of the valve, the hydraulic fluid does not have to provide as much work to continue to open the valve 156.

The effective area and resulting forces provided by the hydraulic fluid onto the pins is reduced when the first pin 152 reaches the stop 174. Consequently the work provided by the hydraulic fluid is lowered after the valve 156 is initially opened. The valve assembly of the present invention thus reduces the work and increases the energy efficiency of the engine. Although each incremental reduction of work during one exhaust stroke is relatively small, when multiplied by the number of strokes during the operation of an engine the resultant increase in energy efficiency can be relatively significant.

Figure 8:
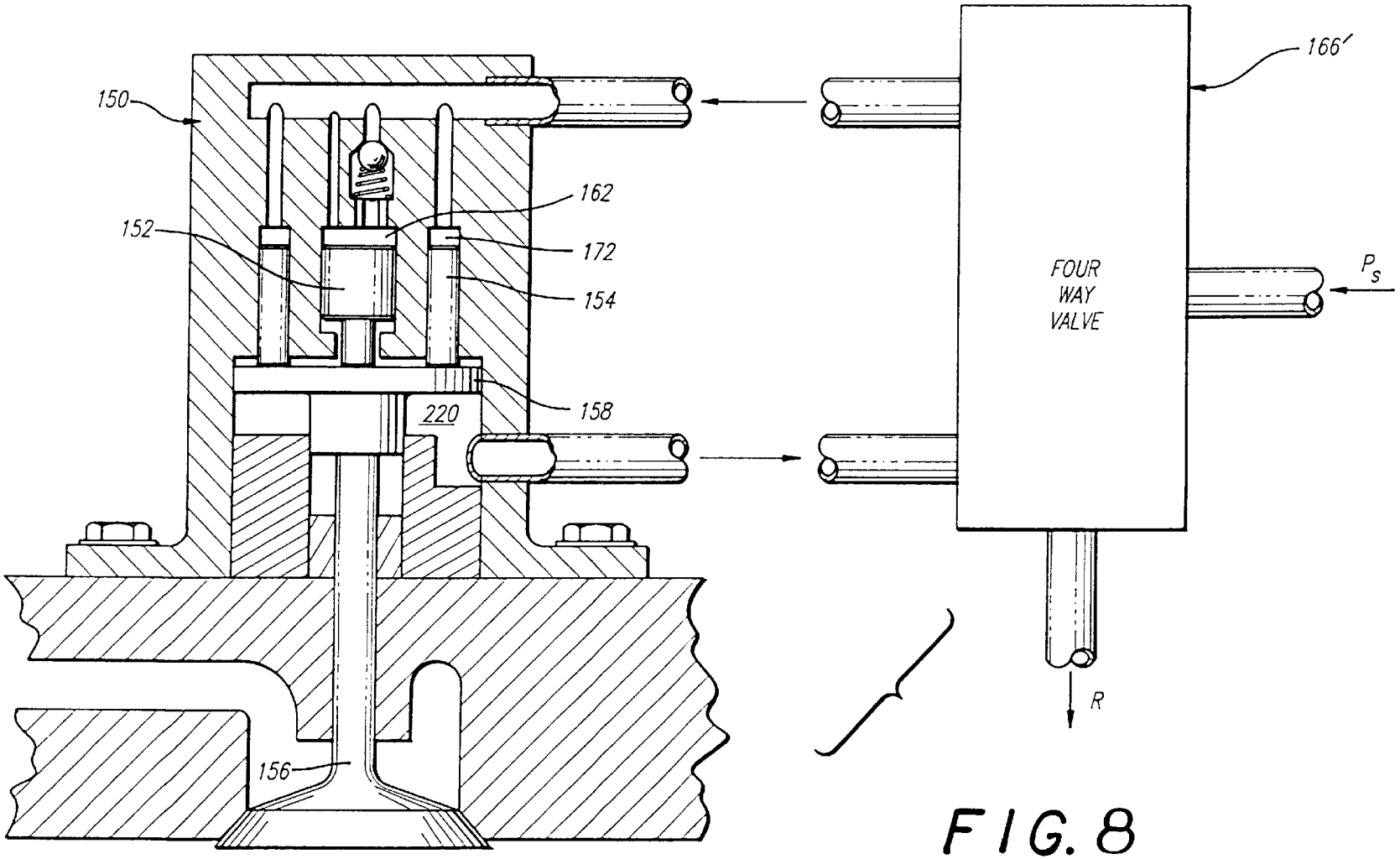
FIG. 8 is a side cross-sectional view of an alternate embodiment of the intake valve of FIG. 6, showing a four-way actuating valve.

FIG. 8 is an alternate embodiment of a valve assembly which has a four-way control valve 166'. The control valve 166' is connected to the pressure chamber 162 and channels 172, and a return chamber 220. The return chamber 220 receives pressurized working fluid that pushes the valve 156 back to the closed position. In operation, the valve 156 is switched to couple the pressure chamber 162 and channel 172 to the high pressure fluid, and the return chamber 220 to drain. The pressurized working fluid exerts a force on the pins 152 and 154 which move the valve 156 to the open position. The control valve 166' is then switched to connect the return chamber 220 to the pressurized working fluid, and the pressure chamber 162 and channels 172 to drain. The working fluid within the return chamber 220 pushes the valve 156 back to the closed position. The control valve 166 is preferably dynamically and statistically pressure balanced to increase the valve speed and reduce the energy consumed by the valve.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A valve assembly for an internal combustion engine, comprising:

a first pin;

a second pin;

a valve housing that has a main channel in fluid communication with a pin channel and an orifice that is in fluid communication with said main channel and a pressure chamber, said pin channel being in fluid communication with said second pin, said pressure chamber being in fluid communication with said first pin, said orifice having a diameter that is smaller than a diameter of said pin channel; and, a valve adapted to move between an open position and a closed position, said valve being coupled to said first pin and said second pin in the closed position, and coupled to said second pin in the open position.

2. The valve assembly of claim 1, further comprising a one-way valve located between said main channel and said pressure chamber.

3. The valve assembly of claim 1, wherein said valve housing includes a stop that limits a movement of said first pin.

4. The valve assembly of claim 1, further comprising a control valve that can be switched to couple said main channel to either a supply line or a drain line.

5. The valve assembly of claim 4, wherein said control valve includes a spool that is coupled to a pair of coils.

6. The valve assembly of claim 5, further comprising a controller adapted to provide a digital pulse to one of said coils to latch said spool into one of two positions.

7. The valve assembly of claim 1, wherein said first pin has a diameter that is larger than a diameter of said second pin.

8. The valve assembly of claim 6, further comprising a sensor that is coupled to said controller and adapted to sense a position of said valve.

9. The valve assembly of claim 1, further comprising a spring that biases said valve into the closed position.

* * * * *